US007854259B2

(12) United States Patent
Davison

(10) Patent No.: US 7,854,259 B2
(45) Date of Patent: Dec. 21, 2010

(54) PC ROD GUIDE WITH ROTOR RIDGES

(75) Inventor: Matthew S. Davison, Oklahoma City, OK (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 357 days.

(21) Appl. No.: 12/009,194

(22) Filed: Jan. 17, 2008

(65) Prior Publication Data

US 2009/0183869 A1 Jul. 23, 2009

(51) Int. Cl.
*E21B 17/10* (2006.01)

(52) U.S. Cl. ..... 166/241.3; 166/241.1; 166/241.2; 166/241.4

(58) Field of Classification Search ..... 166/176, 166/241.1, 241.2, 241.3, 241.4
See application file for complete search history.

(56) References Cited

U.S. PATENT DOCUMENTS 2,046,348 A * 7/1936 Simmons ..... 166/241.2
5,191,938 A 3/1993 Sable et al.
5,339,896 A * 8/1994 Hart et al. ..... 166/241.1
5,692,562 A 12/1997 Squires
5,740,862 A 4/1998 Sable
5,755,284 A 5/1998 Hart et al.
5,873,157 A 2/1999 Hart et al.
5,941,312 A 8/1999 Vermeeren
6,065,537 A 5/2000 Evans et al.
7,255,165 B2 * 8/2007 Abdo et al. ..... 166/241.3

OTHER PUBLICATIONS

R&M Energy Systems, New Era Rod Guides (Rotating), Spin-Thru & Spin-Thru II, 2008, www.rmenergy.com/newera_rotating.html.

* cited by examiner

*Primary Examiner*—Shane Bomar
*Assistant Examiner*—Brad Harcourt
(74) *Attorney, Agent, or Firm*—Browning Bushman P.C.

(57) ABSTRACT

A rod guide is provided for use in a rotating rod string (12) for powering a progressive cavity pump (14) for pumping downhole fluids through tubing (16) to the surface. The rod guide includes a rotor sleeve (20) secured to the rod string. The rotor sleeve includes a plurality of axially spaced reduced diameter body portions 22, and a plurality of axially spaced enlarged diameter ridge portions 24. Upper and lower stop surfaces 26, 28 on the ridge portions permit axial movement of the stator sleeve with respect to the rotor sleeve. A stator sleeve (40) positioned over the rotor sleeve, and has a sleeve body (42) with a generally circular configuration with opposing circumferential ends (44, 46) spreadable to position the stator sleeve about the rotor sleeve. A plurality of ribs (48) extend outward from the stator sleeve body.

20 Claims, 2 Drawing Sheets

PC ROD GUIDE WITH ROTOR RIDGES

FIELD OF THE INVENTION

The present invention relates to a rod guide of a type suitable for guiding a sucker rod within production tubing of an oil or gas well. More particularly, the invention relates to a rod guide for guiding a rotary sucker rod which powers a progressive cavity (PC) pump in a well.

BACKGROUND OF THE INVENTION

Various types of rod guides have been devised for guiding a sucker rod within production tubing. Many rod guides are intended for use with a reciprocating sucker rod, and other rod guides are primarily intended for use with a rotating sucker rod. Some guides have utility for either a reciprocating rod or a rotating rod, although design considerations generally dictate that a sucker rod guide be primarily intended for one application.

Compared to commonly used beam pumps which are powered by a reciprocating sucker rod, progressive cavity pumps are generally able to deal with a high concentration of sand or other particulate in the recovered fluid. In many cases, however, rod guides for PC pumps wear excessively when subjected to the upwardly moving fluid and sand within the production tubing. The cost of replacing PC rod guides for these applications thus represents a significant cost to the well operator. Other rod guides have low erodeable wear volume, i.e., the volume of the guide radially exterior of the rod coupling is minimal, and wear of that excess material reduces the effectiveness of the guide. Other rod guides have poor flow characteristics, meaning that the flow channels around the guide result in a high pressure loss, thereby increasing the power required to pump the fluids to the surface. Other types of rod guides allow sand or other particles to become trapped or imbedded between components of the guide, thereby substantially contributing to premature wear of the guide.

Many rod guides designed for PC pumps include a rotor sleeve secured to the rod string and a stator sleeve positioned about the rotor sleeve. The stator sleeve conventionally has an elongate slot, which is spread apart to position the stator sleeve on the rotor sleeve. The stator is typically spaced about a cylindrical body of the rotor, and between upper and lower stop surfaces on the rotor. U.S. Pat. Nos. 5,191,938, 5,339,896, 5,755,284, 5,692,562 and 6,065,537 disclose rod guides for guiding a sucker rod intended for powering a downhole pump to pump fluids to the surface of a well.

The disadvantages of the prior art are overcome by the present invention, and an improved rod guide particularly suited for guiding a sucker rod powering a progressive cavity pump is hereinafter disclosed.

SUMMARY OF THE INVENTION

In one embodiment, a rod guide for positioning on a rotating sucker rod which powers a downhole progressive cavity pump for pumping downhole fluids to the surface includes a rotor sleeve secured to the rod, and a stator sleeve positioned about the rotor sleeve. The stator sleeve has a sleeve body with a generally circular configuration and a slot defining opposing circumferential ends spreadable to position the stator sleeve about the rotor sleeve. The stator sleeve has a plurality of ribs extending outward from the sleeve body for passing fluid between the stator sleeve body and tubing and circumferentially between the two or more ribs. The rotor sleeve has a plurality of body portions each having an exterior surface of a reduced diameter, and a plurality of ridge portions each having a substantially cylindrical exterior surface of an enlarged diameter greater than the reduced diameter and generally concentric with the rod string. The stator sleeve has an inner surface defining a plurality of substantially cylindrical enlarged diameter portions each with an inner surface adjacent the exterior surface of a respective ridge portion and a plurality of reduced diameter portions each having a diameter less than the enlarged diameter portions for positioning adjacent an inner surface of a reduced diameter body portion.

According to one embodiment of the method of the invention, the rotor sleeve is secured to the sucker rod, and the stator sleeve is positioned about the rotor sleeve. The stator sleeve has a sleeve body with a generally circular configuration with opposing circumferential ends separable to position the stator sleeve about the rotor sleeve, and has a plurality of ribs extending outward from the sleeve body. The method includes providing a rotor sleeve with a plurality of substantially cylindrical ridge portions each having a substantially cylindrical exterior surface of an enlarged diameter greater than the reduced diameter of the body portions on the rotor sleeve. The method further includes providing a stator sleeve with an interior surface defining a plurality of substantially cylindrical enlarged diameter portions each with an inner surface adjacent the exterior surface of a respective ridge portion and a plurality of reduced diameter portions each having a diameter less than the enlarged diameter portions for positioning adjacent an inner surface of a reduced diameter body portion.

A feature of the present invention is to provide a rod guide for guiding a sucker rod for powering a progressive cavity pump wherein the rotor is secured to the sucker rod and includes a plurality of upper and lower stop surfaces each at the upper and lower ends of a respective ridge for limiting axial movement of the stator with respect to the rotor. It is a further feature of the present invention to provide a rod guide for a rotating sucker rod with improved wear characteristics.

These and further features and advantages of the present invention will become apparent from the following detailed description, wherein reference is made to the figures in the accompanying drawings.

DETAILED DESCRIPTION OF PREFERRED EMBODIMENTS

Figure 1:
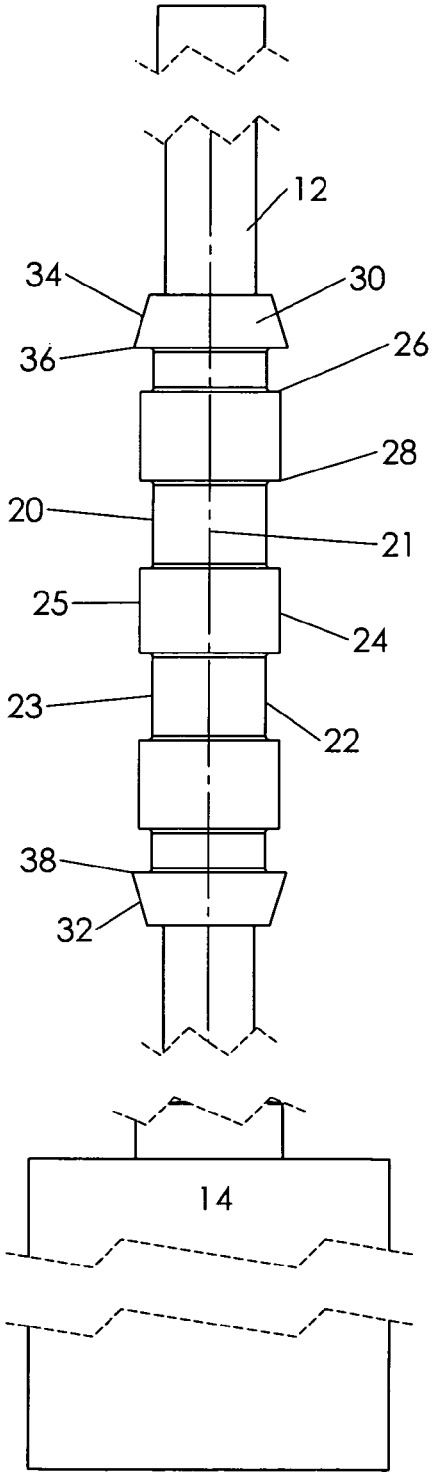
FIG. 1 is a side view of a rod guide rotor according to the present invention secured to a sucker rod.
Figure 3:
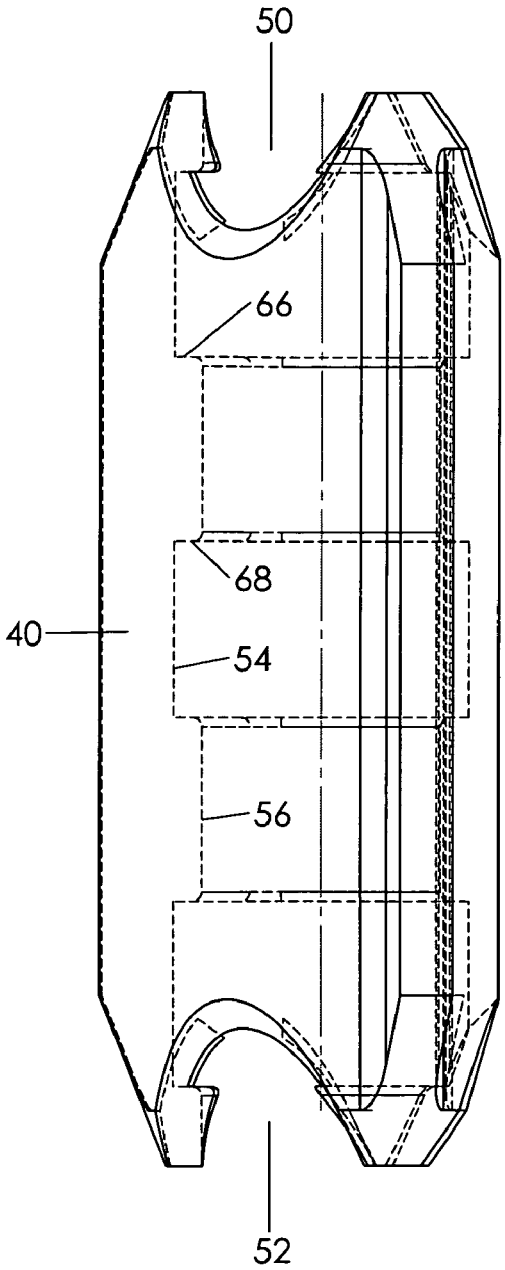
FIG. 3 illustrates one embodiment of a rod guide stator for supporting on the rotor as shown in FIG. 1.

FIG. 1 depicts one embodiment of a rotor sleeve according to the present invention. FIG. 3 depicts a suitable stator sleeve according to the present invention. The rotor sleeve and the stator sleeve together define a rod guide, which guides a rotating rod string for powering a progressive cavity pump intended to pump fluid past the rod guide through production tubing and to the surface. The rotor sleeve as shown in FIG. 1 is preferably molded directly to the sucker rod 12, and is of a unitary construction. A plurality of rod guides are thus provided along the length of the sucker rod, with the rotating sucker rod powering the PC pump, generally shown as 14 in FIG. 1.

The rotor sleeve 20 includes a plurality of body portions 22 each having an exterior surface 23 of a reduced diameter, and a plurality of ridge portions 24 each having a substantially cylindrical exterior surface 25 of an enlarged diameter greater than the reduced diameter body portions. Each of these outer surfaces is preferably concentric with the rod string, and each of a plurality of ridge portions 24 is axially adjacent at least one and in many cases an upper and a lower reduced diameter body portion. Each of the ridge portions 24 includes an upper stop surface 26 and a lower stop surface 28, with each stop surface lying within a plane substantially perpendicular to a central axis 21 of the rotor sleeve and thus the rod string 12. The purpose of the stop surfaces is explained below.

For many applications, the rotor sleeve includes three or more body portions and three or more ridge portions. The rotor sleeve also includes at least one end cap 30, 32, and preferably both an upper end cap 30 and a lower end cap 32. Each end cap has a conical outer surface 34 with a central axis aligned with the rod string central axis 21 and an apex spaced from the rotor sleeve. A lower stop surface 36 is formed on the upper end cap 30, and an upper stop surface 38 is formed on the lower end cap 32. These stop surfaces are also preferably perpendicular to the central axis of the rotor.

Figure 2:
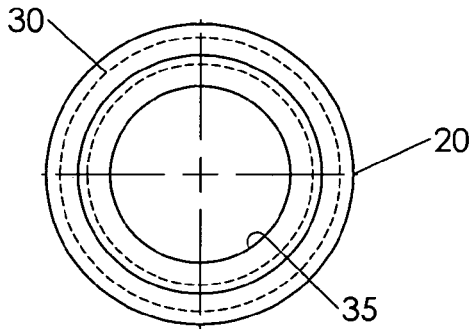
FIG. 2 is a top view of the rod guide shown in FIG. 1.

FIG. 2 is a top view of the rod guide rotor sleeve 20 shown in FIG. 1. The cylindrical bore 35 of the rotor sleeve is thus in direct contact with the rod 12, and preferably the rotor is molded directly to the rod 12.

Figure 4:
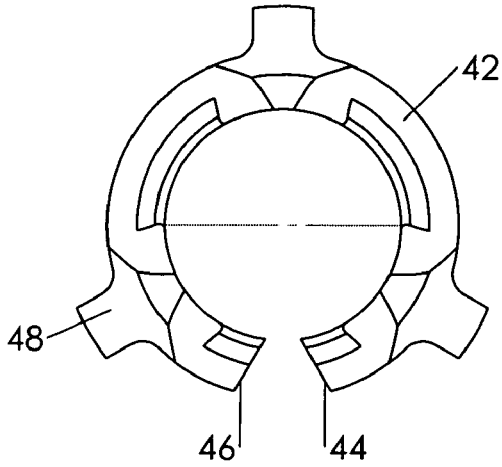
FIG. 4 is a top view of the stator shown in FIG. 3.

FIG. 3 depicts a suitable stator sleeve 40 for positioning about the rotor sleeve, thereby allowing the rotor sleeve to rotate relative to the stator sleeve. The stator sleeve 40 includes a substantially C-shaped body 42, as shown in FIG. 4, and a plurality of ribs 48 each extending radially outward from the sleeve-shaped body for engaging an inner wall of the tubing string. Circumferential ends 46, 44 of the C-shaped body allow the stator sleeve to be spread apart to be positioned on the rotor sleeve and then returned to substantially its original configuration with the stator sleeve positioned about the rotor sleeve. The design as shown in FIG. 3 includes a plurality of upper scallops 50 and a plurality of lower scallops 52 in the ends of the stator sleeve, with each of these scallops having a substantially U-shaped or inverted U-shaped configuration. According to another embodiment, the scallops 50, 52 may be eliminated.

The stator sleeve 40 includes an interior surface defining a plurality of substantially cylindrical large diameter portions 54 each with an inner surface adjacent an exterior surface of a respective ridge portion, and a plurality of reduced diameter portions 56 each having a diameter less than the enlarged diameter stator portions for positioning adjacent a respective exterior surface of a reduced diameter body portion. While the surfaces 23, 25 on the rotor sleeve and the surfaces 54, 56 on the stator sleeve are each preferably cylindrical surfaces, it is primarily important that the enlarged diameter ridge portions 24 have a cylindrical surface 25, since the rotor sleeve is generally the component of a rotating rod guide which first fails. Since the surface 25 is the largest diameter surface on the rotor sleeve which mates with a sliding surface on the stator sleeve, the surface 25, and preferably the surface 54, are both cylindrical surfaces. It should be understood that the term "diameter" as used herein with regard to these surfaces is not limited to a structure which is cylindrical or even circular configuration. The "diameter" of a body portion or a reduced diameter portion on the stator sleeve is thus the largest diameter of this surface when rotating. In some applications, there may be a benefit to providing one or more recesses or other discontinuities in these wear surfaces.

FIG. 4 depicts three axially extending ribs 48. According to the present invention, a plurality of ribs are preferably provided, and in many applications two or more ribs will contact the inner surface of a tubing string when the rod string is rotated.

Referring now to FIGS. 1 and 3, it should be understood that the stop surfaces 66, 68 are each also preferably perpendicular to the central axis of the rod string, and mate with the stop surfaces 26, 28 on the rotor sleeve to limit axial movement of the rotor sleeve with respect to the stator sleeve. Most importantly, the engagement of one or both of the surfaces 26, 66 and 28, 68 prevents sand or other debris from migrating axially through the rod guide and between the rotor and stator, thereby creating a high wear condition. The primary purpose of the surfaces 26, 28, 66 and 68 is thus to significantly reduce the amount of sand or other debris that can migrate between the stator and the rotor. Although upper and lower stop surfaces on the ridge portions are preferable, in some applications only one of the mating surfaces 26, 66 or 28, 68 may be used to limit travel of sand and other debris between the stator and the rotor. Surfaces 54, 25, and to a lesser extent the surfaces 56, 23, thus provide a large surface area of sliding contact between the rotor and the stator sleeve, thereby enhancing the life of the guide. The rotor sleeve preferably includes three or more body portions and three or more ridge portions, and the stator preferably includes an equal number of large diameter and reduced diameter internal surfaces.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A rod guide for guiding a rotating rod string rotatable within a tubing string in a well for powering a progressive cavity pump to pump downhole fluids to the surface, the rod guide comprising:

a rotor sleeve secured to the rod string, the rotor sleeve including a plurality of body portions each having an exterior surface of a reduced diameter, and a plurality of ridge portions each having a substantially cylindrical exterior surface of an enlarged diameter greater than the reduced diameter body portions and concentric with the rod string, each of the plurality of ridge portions is axially adjacent at least one reduced diameter body portion, each of the plurality of body portions and ridge portions fixed relative to the rod string; and a unitary stator sleeve positioned about the rotor sleeve, such that the rotor sleeve rotates relative to the stator sleeve, the stator sleeve including a substantially C-shaped body with an elongate slot between ends of the C-shaped body and a plurality of ribs each extending radially outward from the sleeve shaped body for engaging an inner wall of the tubing string, the stator sleeve having an interior surface defining a plurality of substantially cylindrical enlarged diameter portions each with an inner surface adjacent the exterior surface of a respective ridge portion and a plurality of reduced diameter portions each having a diameter less than the enlarged diameter stator portions for positioning adjacent a respective exterior surface of a reduced diameter body portion, thereby axially retaining the stator sleeve on the rotor sleeve.

2. A rod guide as defined in claim 1, wherein the rotor sleeve includes three or more body portions and three or more ridge portions.

3. A rod guide as defined in claim 1, wherein the rotor sleeve is molded to the rod string and is of a unitary construction.

4. A rod guide as defined in claim 1, wherein each of the ridge portion includes an upper stop surface substantially perpendicular to a central axis of the rod string for engagement with the stator sleeve and a lower stop surface substantially perpendicular to the central axis of the rod string for engagement with the stator sleeve.

5. A rod guide as defined in claim 1, further comprising:

the rotor sleeve including at least one end cap, the end cap having a conical outer surface with the central axis substantially aligned with the rod string central axis and an apex spaced from the rotor sleeve.

6. A rod guide as defined in claim 1, wherein the stator sleeve includes one or more scallop cutouts in an end surface and between two of the plurality of ribs.

7. A rod guide as defined in claim 1, wherein the stator sleeve includes three or more radially extending ribs.

8. A rod guide for guiding a rotating rod string rotatable within a tubing string in a well for powering a progressive cavity pump to pump downhole fluids to the surface, the rod guide comprising:

a rotor sleeve molded to the rod string, the rotor sleeve including a plurality of body portions each having a substantially cylindrical exterior surface of a reduced diameter, and a plurality of ridge portions each having a substantially cylindrical exterior surface of an enlarged diameter greater than the reduced diameter body portions and concentric with the rod, each of the plurality of body portions and ridge portions fixed relative to the rod string; and a unitary stator sleeve positioned about the rotor sleeve, such that the rotor sleeve rotates relative to the stator sleeve, the stator sleeve including a substantially C-shaped body with an elongate slot between ends of the C-shaped body and three or more ribs each extending radially outward from the sleeve shaped body for engaging an inner wall of the tubing string, the stator sleeve moved radially relative to the rotor sleeve and the rod string to widen the slot when the stator sleeve is installed on the rotor sleeve, the stator sleeve moves radially relative to the rotor sleeves and the rod string to widen the slot where the stator sleeve is installed on the rotor sleeve the stator sleeve having an interior surface defining a plurality of substantially cylindrical enlarged diameter portions each with an inner surface adjacent the exterior surface of a respective ridge portion and a plurality of reduced diameter stator portions each having a substantially cylindrical exterior surface of a reduced diameter less than the enlarged diameter stator portions for positioning adjacent a respective exterior surface of a reduced diameter body portion, thereby axially retaining the stator sleeve on the rotor sleeve.

9. A rod guide as defined in claim 8, wherein the rotor sleeve is of a unitary construction.

10. A rod guide as defined in claim 8, wherein each of the ridge portion includes an upper stop surface substantially perpendicular to a central axis of the rod string for engagement with the stator sleeve and a lower stop surface substantially perpendicular to the central axis of the rod string for engagement with the stator sleeve.

11. A rod guide as defined in claim 8, further comprising:

the rotor sleeve including at least one end cap, the end cap having a conical outer surface with the central axis substantially aligned with the rod string central axis and an apex spaced from the rotor sleeve.

12. A rod guide as defined in claim 8, wherein the rotor sleeve includes three or more body portions and three or more ridge portions.

13. A rod guide for guiding a rotating rod string rotatable within a tubing string in a well for powering a progressive cavity pump to pump downhole fluids to the surface, the rod guide comprising:

a rotor sleeve secured to the rod string, the rotor sleeve including a plurality of body portions each having an exterior surface of a reduced diameter, and a plurality of ridge portions each having a substantially cylindrical exterior surface of an enlarged diameter greater than the reduced diameter body portions and concentric with the rod string each of the plurality of ridge portions is axially adjacent at least one reduced diameter body portion, each of the plurality of body portions and ridge portions fixed relative to the rod string;

a stator sleeve positioned about the rotor sleeve, such that the rotor sleeve rotates relative to the stator sleeve, the stator sleeve including a unitary substantially C-shaped body with an elongate slot between ends of the C-shaped body and a plurality of ribs each extending radially outward from the sleeve shaped body for engaging an inner wall of the tubing string, the stator sleeve having an interior surface defining a plurality of enlarged diameter portions each with an inner surface adjacent the exterior surface of a respective ridge portion and a plurality of reduced diameter portions each having a diameter less than the enlarged diameter stator portions for positioning adjacent a respective exterior surface of a reduced diameter body portion; and each of the ridge portion includes an upper stop surface substantially perpendicular to a central axis of the rod string for engagement with the stator sleeve and a lower stop surface substantially perpendicular to the central axis of the rod string for engagement with the stator sleeve.

14. A rod guide as defined in claim 13, wherein the rotor sleeve includes three or more body portions and three or more ridge portions.

15. A rod guide as defined in claim 13, wherein the rotor sleeve is molded to the rod string and is of a unitary construction.

16. A rod guide as defined in claim 13, further comprising:

the rotor sleeve including at least one end cap, the end cap having a conical outer surface with the central axis substantially aligned with the rod string central axis and an apex spaced from the rotor sleeve.

17. A rod guide as defined in claim 13, wherein the stator sleeve includes three or more radially extending ribs.

18. A rod guide as defined in claim 13, wherein the stator sleeve includes one or more scallop cutouts in an end surface and between two of the plurality of ribs.

19. A rod guide as defined in claim 13, wherein each of a plurality of large diameter portions on the stator sleeve has a substantially cylindrical interior surface defining a respective one of the plurality of enlarged diameter portions.

20. A rod guide as defined in claim 13, wherein each of the rotor sleeve and the stator sleeve are formed from a plastic material.

* * * * *